United States Patent [19]

Knoedler et al.

[11] Patent Number: 4,799,700

[45] Date of Patent: Jan. 24, 1989

[54] COLLAPSIBLE WALKER

[75] Inventors: Roy E. Knoedler, Boulder, Colo.; Kenneth P. Morton, East Aurora, N.Y.; Charles E. Schroer, Columbus, Ind.

[73] Assignee: Cosco, Inc., Columbus, Ind.

[21] Appl. No.: 105,920

[22] Filed: Oct. 8, 1987

[51] Int. Cl.[4] ..... A47D 13/04; B62B 7/06

[52] U.S. Cl. ..... 280/87.051; 280/87.05; 280/649; 297/6; 272/70.3; 108/120

[58] Field of Search ..... 280/87.01, 87.02, 87.02 W, 280/87.03, 87.04 R, 87.05, 649; 297/5, 6, 16, 56, 307; 108/117, 119, 120, 146; 272/70.3

[56] References Cited

U.S. PATENT DOCUMENTS

| | | | |
|---|---|---|---|
| 2,198,813 | 4/1940 | Hall | 280/7.1 |
| 2,538,324 | 1/1951 | Petrie | 280/87.02 W |
| 2,806,747 | 9/1957 | Jaeger | 108/117 |
| 3,003,780 | 10/1961 | Lundahl | 280/43 |
| 3,265,157 | 8/1966 | Rissler | 280/33.99 C X |
| 3,608,693 | 9/1971 | Stosberg | 280/33.99 C X |
| 4,019,756 | 4/1977 | Ishida | 280/649 |
| 4,045,045 | 8/1977 | Boucher et al. | 280/87.02 W |
| 4,145,682 | 3/1979 | Cook | 340/52 H |
| 4,171,132 | 10/1979 | Kassai | 280/87.05 X |
| 4,231,582 | 11/1980 | Moss | 280/87.02 W |
| 4,359,242 | 11/1982 | Gerken et al. | 280/87.02 W |
| 4,364,576 | 12/1982 | Kassai | 280/87.02 W |
| 4,480,846 | 11/1984 | Sanchez | 280/87.02 W |
| 4,576,392 | 3/1986 | Quinlan, Jr. | 280/87.02 W |
| 4,579,359 | 4/1986 | Schwartz | 280/87.02 W |
| 4,621,804 | 11/1986 | Mueller | 280/87.02 W X |
| 4,699,392 | 10/1987 | Ku | 280/87.02 W |

FOREIGN PATENT DOCUMENTS

| | | | |
|---|---|---|---|
| 1219914 | 5/1960 | France | 108/120 |

*Primary Examiner*—David M. Mitchell
*Assistant Examiner*—Brian L. Johnson
*Attorney, Agent, or Firm*—Barnes & Thornburg

[57] ABSTRACT

A baby walker is provided and includes a base, seat for carrying a load, a frame operably connecting the base and the seat for permitting relative movement of the seat and the base between a fully collapsed position and at least two elevated positions, and a control system coupled to the base for selectively engaging the frame to position the seat in one of the at least two elevated positions to aid in preventing inadvertent movement of the seat to its fully collapsed position. The base includes a pair of eccentrically mounted pivot arms for lowering the base to a braking position upon movement of a support wheel on one of the pivot arms over an edge of an underlying surface.

14 Claims, 1 Drawing Sheet

COLLAPSIBLE WALKER

BACKGROUND AND SUMMARY OF THE INVENTION

The present invention relates to collapsible baby walkers, and more particularly to a collapsible baby walker-jumper having an eccentrically mounted pivotable wheel assembly and an actuator for establishing a partially collapsed "safety" position during folding of the walker-jumper and selectively controlling movement of a collapsible frame from the partially collapsed safety position to a fully collapsed "storage" position.

One object of the present invention is to provide a system on a collapsible baby walker or the like for guarding against accidental or inadvertent folding of the walker to a fully collapsed storage position. Typically, a baby walker includes a seat means that is folded into an opening in a base means by means of a collapsible frame assembly. Desirably, such a system would be configured to permit some movement of the seat means relative to the base means to allow for varying the height of the seat means between two or more "use" positions of different elevation, yet prevent complete collapse of the seat means into the base means unless such movement was contemplated.

Another object of the present invention is to Provide a secondary control system for automatically establishing a partially collapsed safety position of the seat means relative to the base means intermediate the use and storage positions of the seat means during normal collapsing movement of the baby walker. Desirably, such a secondary control system is operable independent of a primary control system for controlling the elevation of the seat means relative to the base means to establish the various predetermined use positions of the seat means. Advantageously, such independent operation aids in preventing accidental manipulation of the primary control system which might otherwise cause the seat means to fall to its fully collapsed position within the base means.

Yet another object of the present invention is to provide at least two eccentrically mounted pivotable rolling units for lowering the base from a normal rolling position above an underlying surface to a braking position in frictional engagement with the underlying surface upon movement of one of the rolling units over an edge of the underlying surface. Edge detection of a pivotable rolling unit is advantageously enhanced by eccentrically mounting certain of the pivotable rolling units to position each wheel of those rolling units in close proximity to the periphery of the base. Further, positioning the eccentric pivot axis underneath the approximate center of mass of a loaded seat aids in improving the overall stability of the baby walker when exposed to tip-inducing forces.

According to the present invention, a baby walker is provided comprising a base, seat means for carrying a child, and frame means for operably interconnecting the base and the seat means to permit guided collapsing movement of the seat means relative to the base from an elevated use position to a fully collapsed storage position. The baby walker further includes first control means for blocking relative movement of the seat means and the frame means to elevate the seat means to the elevated use position above the base and second control means for blocking relative movement of the frame means and the base to establish a partially collapsed position intermediate the use and storage positions to aid in preventing inadvertent movement of the seat means to its fully collapsed storage position.

In preferred embodiments, the second control means is coupled to the base and the second control means includes blocking means for intercepting a predetermined portion of the frame means during collapsing movement thereof, spring means for yieldably biasing the blocking means to a frame means-intercepting position, and actuation means for retracting the blocking means against the spring means to permit relative movement of the frame means and the base from the partially collapsed position to the fully collapsed storage position.

Preferably, a baby walker in accordance with the present invention includes rolling means for rollably supporting the base on an underlying surface. The rolling means includes at least three rolling units arranged in spaced relation about a peripheral portion of the base. Advantageously, eccentric means is provided for pivotally coupling each of a pair of the rolling units to the base for pivotable movement of each said rolling unit relative to the base about an eccentric horizontal pivot axis offset relative to the longitudinal midpoint portion of each said rolling unit.

DETAILED DESCRIPTION OF THE DRAWINGS

Figure 1:
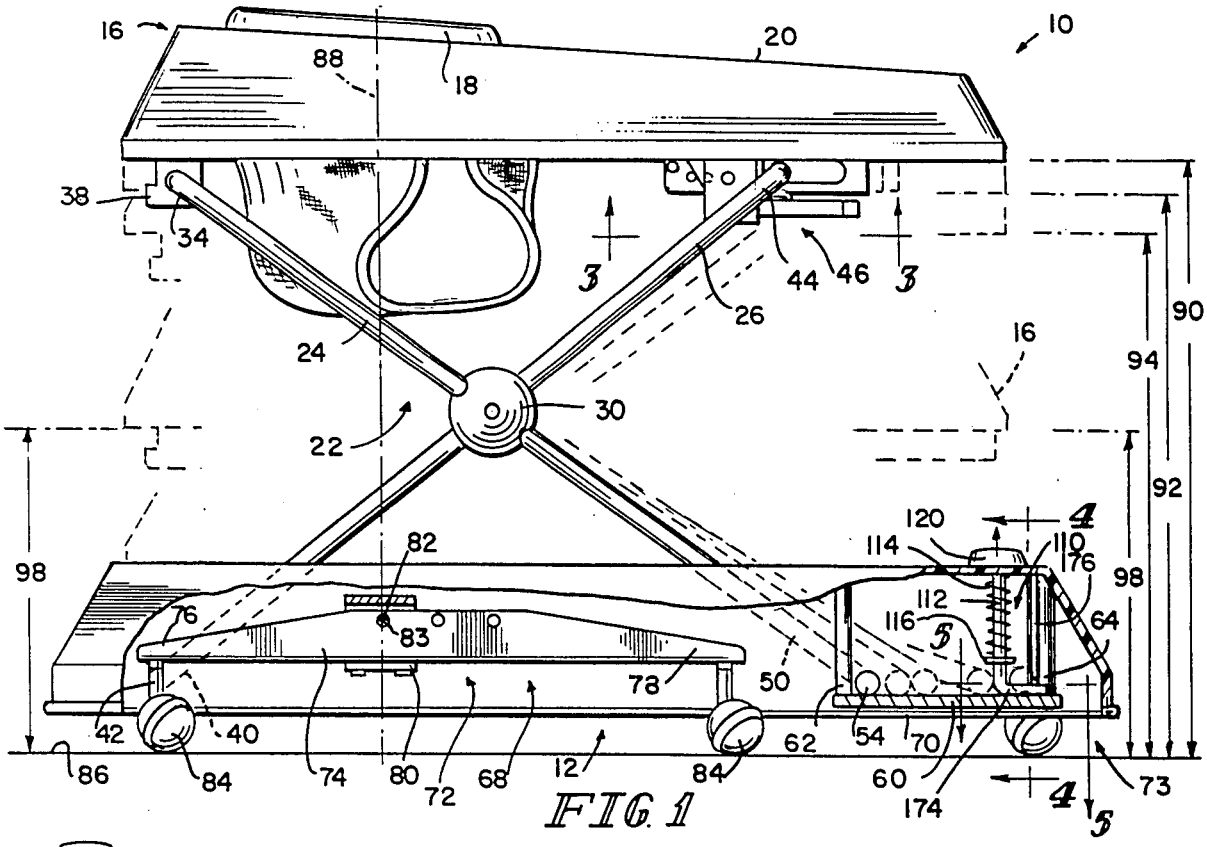
FIG. 1 is a side elevation view, with portions broken away, of an illustrative embodiment of the present invention showing a plurality of "use" positions, a partially collapsed "safety" position, and a fully collapsed "storage" position of the seat means.

Referring now to the drawings, and specifically to FIG. 1, FIG. 1 shows a baby walker 10 of the present invention. FIG. 1 illustrates the three extended "use" positions of the walker 10, and also illustrates the configuration of the barrier means which releasably retains the walker 10 in a partially collapsed "safety" position. In addition, FIG. 1 illustrates the configuration of the side roller units in which the pivot position of the roller unit is offset from the center of the unit to provide for more stability to the walker 10.

The walker 10 includes a shroud-like base member 12 which is somewhat rectangular in shape. A support member 16 is suspended above the base member 12 and is configured to include a seat 18 for supporting and positioning a child (not shown) within the walker 10. The support member 16 includes a tray portion 20 that is oriented generally in front of the seat 18. A frame assembly 22 is provided to suspend the support member 16 at selected elevated positions above the base member 12. The frame assembly 22 includes first frame members 24 which generally extend from a rear portion of the support member 16 to a forward portion of the base member 12. Second frame members 26 are provided that generally extend from a forward portion of the support member 16 to a rearward portion of the base member 12. It will be understood that only one side of the walker 10 is illustrated in FIG. 1 and therefore the discussion will be directed to only one first frame member 24 and one second frame member 26.

The first frame member 24 and second frame member 26 intersect and are coupled at a point approximately near the centers of the members by a frame pivot member 30. The frame pivot member 30 is rotatable so that the first frame member 24 and second frame member 26 are permitted to rotate with respect to each other to Permit the support member 16 to assume different elevated positions relative to the base member 12, as will be discussed below.

The first frame member 24 includes an upper end 34 that is journaled for pivotal movement in a pivot mount 38 that is attached to the underneath side of the rear portion of the support member 16. The lower end 40 of the second frame member 26 is attached for pivotal movement to the rear portion of the base member 12 by a pivot pin 42. The upper end 44 of the second frame member 26 is attached to a height adjustment means 46 which is attached to the underneath side of the support member 16. The height adjustment means 46 functions to permit the support member 16 to be positioned to any one of three selected elevated, use positions, with the highest use position being illustrated in FIG. 1, and the two, somewhat lower use positions being shown in dotted line. The height adjustment means 46 is illustrated in more detail in FIG. 3, however for a detailed description of its structure and use reference is made to U.S. Pat. No. 4,359,242 to Gerken et al, the disclosure of which is hereby incorporated herein by reference in its entirety.

The lower end 50 of the first frame member 24 includes an outwardly turned rod end 54 that is configured to slide along a slide track 60 that is mounted in the base member 12. Specifically, the slide track 60 provides floor means for supporting the rod end 54 for sliding movement within the base member 12. The rod end 54 is permitted to slide along the slide track 60 from a rearward position defined by a substantially vertical stop member 62 and a fully forward position defined by a substantially vertical stop member 64. It will be understood in referring to FIG. 1 that, when the rod end 54 is at the rearward position abutting the stop member 62, the support member 16 will be in the fully extended use position illustrated in FIG. 1. When the rod end 54 is at the forward position abutting the stop member 64, the support member 16 will be in its lowest storage position where the support member 16 is mated with the base member 12 which is illustrated in dotted line in FIG. 1. The use of the slide track 60 for supporting the lower end 50 of the first frame member 24 is also described in U.S. Pat. No. 4,359,242 and reference is made to that patent for further description of the use and function of the slide track 60.

Figure 2:
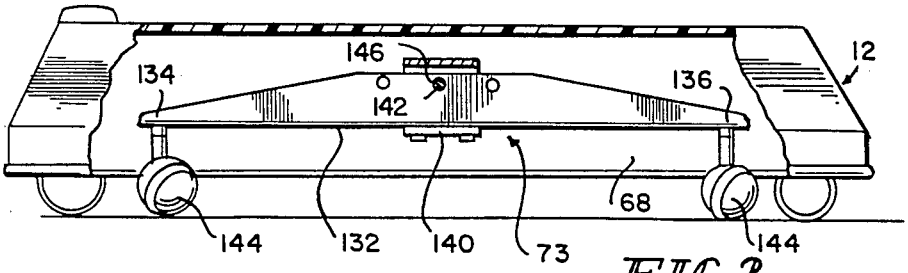
FIG. 2 is a front elevation view, with portions broken away, of the base means shown in FIG. 1.

A cavity 68 is formed within the base member 12 which houses two side rolling units 72 (only one of which is shown) and a forward rolling unit 73 (best illustrated in FIG. 2). The use of the pivoting rolling units 72 and 73 to enhance the safety of the walker 10 is specifically described in U.S. Pat. No. 4,699,392 filed Apr. 24, 1986, the entire disclosure of which is hereby incorporated herein by reference.

A base grip 70 is disposed around the lower Peripheral edge of the base member 12, the use of which will be discussed later. The configuration of the base grip 70 is shown in greater detail in FIG. 4. Illustratively, the base grip 70 is formed from a Pliable friction material such as, for example, rubber or another suitable synthetic, rubber-like material.

The side rolling unit 72 includes an elongated pivot arm 74 which has a rearward end 76 and a forward end 78. A bracket 80 is provided in the cavity 68 of the base member 12 on which the pivot arm 74 is mounted for pivotal movement. Specifically, the bracket 80 includes a pivot pin 82 which extends through a hole 83 in the pivot arm 74. As can be seen in FIG. 1, the pivot arm 74 is mounted on the bracket 80 such that the pivot arm 74 pivots in the bracket 80 about a point displaced from its center. Specifically, the pivot arm 74 is mounted in the bracket 80 such that the rearward end 76 is closer to the pivot point defined by the pivot pin 82 than the forward end 78.

By having the pivot point of the pivot arm 74 located at this somewhat rearward position, the pivot point defined by the pivot pin 82 is advantageously located on or near a plane 88 which passes through the center of gravity of the walker 10. By locating the pivot point of the rolling unit 72 on or near the plane 88 defined by the center of gravity of the walker 10, the walker 10 is significantly more stable during normal operation than would otherwise occur if the pivot point were located at a position forward of the plane 88. It will be understood that, if the pivot point of the rolling unit 72 were located substantially forward of the plane 88 defined by the center of gravity of the walker 10, the walker 10 would possibly be susceptible to tipping backward if the child in the seat 18 leaned far enough back, or if some external force was applied to the rear portion of the support member 16. This possibility of tipping backward is decreased substantially by locating the pivot point of the rolling unit 72 at or substantially near the center of gravity of the walker 10.

A wheel 84 is disposed on each end of the pivot arm 74 to permit rolling movement of the rolling unit 72, and hence the walker 10 over a floor or surface 86. It will be understood from the description in U.S. Pat. No. 4,699,392 that it is advantageous to have one wheel 84 disposed Substantially near the rear portion of the base member 12, and the second wheel 84 of the rolling unit 72 disposed substantially forward on the base member 12. It is primarily for this reason that the off-center mounting of the pivot arm 74 is provided. Specifically, the off-center mounting of the pivot arm 74 permits the forward-most wheel 84 of the rolling unit 72 to be located substantially forward on the base member 12, and in addition permits the rolling unit 72 to pivot about the somewhat rearwardly located center of gravity of the walker 10. Thus, the off-center mounting of the rolling unit 72 provides the advantages of permitting a long pivot arm 74, and permitting the pivot arm 74 to pivot about a rearwardly located pivot point.

The use of the height adjustment means 46, in combination with the first frame member 24 and second frame member 26, permits the support member 16 to be positioned at any of three selected extended use positions. Specifically, the support member 16 can be adjusted to one of three selected distances or dimensions above the floor or surface 86. The position illustrated in FIG. 1 shows the support member 16 extended a first dimension 90 above the surface 86. The second position shown in dotted line illustrates the support member 16 a second dimension 92 above the surface 86. Likewise, the third position also shown in dotted line illustrates the support member 16 a third dimension 94 above the surface 86. These three extended use positions are the normal use positions that are utilized when the walker 10 is being used by a child.

In addition to the three extended use positions described above, the support member 16 is also collapsible to a position where the support member 16 is in contact with the base member 12 to provide a non-use, storage configuration. This position is also controlled by the height adjustment means 46 in a manner described in U.S. Pat. No. 4,359,242. Specifically, the height adjustment means 46 is actuated while the support member 16 is in one of the elevated use positions, and the first frame member 24 and second frame member 26 pivot about the frame pivot member 30 to permit the rod end 54 of the first frame member 24 to slide toward the second stop member 64 in the slide track 60. It will be understood that, once the support member 16 passes the third extended use position where the support member 16 is the third dimension 94 above the surface 86, the support member 16 will continue toward its mating position with the base member 12 unless a further stop device is provided to interrupt the downward movement of the support member 16. It will be understood that it is advantageous to prevent the support member 16 from moving in an uninterrupted manner to mate with the base member 12 in order to protect a child seated in the walker 10 from possible injury, or in order to prevent the support member 16 from possibly closing on the hand of an operator attempting to collapse the unit.

To provide an interruption in the movement of the support member 16 toward the base member 12, a stop means or blocking member assembly 110 is provided to temporarily position the support member 16 in an intermediate, partially collapsed "safety" position. The partially collapsed position is located a distance illustrated by the dimension 98 above the surface 86 and is illustrated in dotted line in FIG. 1.

The blocking member assembly 110 includes a blocking pin 112 which moves from an extended position (shown in FIG. 1) to a retracted position (not shown). A spring 114 is provided to yieldably bias the blocking pin 112 to the extended position. In the extended position, the blocking pin 112 blocks movement of the rod end 54 of the first frame member 24 as the support member 16 is being lowered. By blocking movement of the rod end 54, the support member 16 is stopped in the intermediate, partially collapsed position a distance illustrated by the dimension 98 above the surface 86. This blocking position of the rod end 54 by the pin 112 is illustrated in dotted line in FIG. 1. A collar or limit means 116 is disposed on the blocking pin 112 to limit the axially upward movement of the blocking pin 112 toward its retracted position.

A handle 120 is provided to permit the operator to move the blocking pin 112 upwardly against the biasing force provided by the spring 114 toward the retracted position. When the blocking pin 112 is moved upwardly to the retracted position, the rod end 54 is permitted to continue moving toward the second stop member 64 to permit the support member 16 to move from the intermediate, partially collapsed position to the fully collapsed position where the support member 16 is in contact with the base member 12. Thus, the support member 16 is only permitted to move to the fully collapsed position by an intentional movement by the operator of the handle 120 on the blocking member assembly 110. Thus, the blocking member assembly 110 provides a safety device which must be intentionally disabled before the support member 16 can be positioned in contact with the base member 12. Further details of the blocking member assembly 110 will be discussed below in the discussion related to FIG. 5.

FIG. 2 shows the front rolling unit 73 mounted within the cavity 68 in the base member 12. As can be seen, the front rolling unit 73 includes a pivot arm 132 similar to the pivot arm 74 in the side rolling unit 72. The pivot arm 132 includes a first end 134 and a second end 136. The pivot arm 132 is mounted for pivotal movement on a bracket 140 that is attached to the base member 12 in the cavity 68.

Specifically, the pivot arm 132 is mounted for pivotal movement on the bracket 140 by a pivot pin 142. As can be seen in FIG. 2, the pivot pin 142 extend through a hole 146 that is formed in the center of the pivot arm 132. By mounting the pivot arm 132 in the center hole 146, the first end 134 and second end 136 are substantially equidistant from the pivot point defined by the pivot pin 142. Thus, unlike the rolling unit 72 in the side of the base member 12, the front rolling unit 73 is mounted for pivotal movement substantially near the center of the pivot arm 132. Assuming that the center of gravity of the walker 10 with respect to the sides of the walker 10 is located substantially near the center of the unit, the front rolling unit 73 will thus pivot about a pivot point substantially near this lateral center of gravity. With this configuration, all of the rolling units of the walker 10 pivot substantially near the center of gravity of the device. This provides for increased stability of the unit when operating on a surface such as the surface 86.

Wheels 144 are provided on each end 134, 136 of the pivot arm 132 to permit rolling movement on the surface 86. Again, the advantages of a pivoting rolling unit such as the front rolling unit 73 are discussed in U.S. Pat. No. 4,699,392 which has been incorporated herein by reference.

Figure 3:
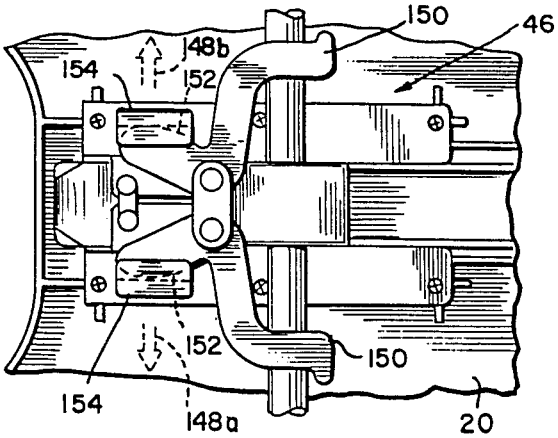
FIG. 3 is a sectional view taken along lines 3—3 of FIG. 1.

The height adjustment means 46 included on the walker 10 is shown in greater detail in FIG. 3. As stated previously, the height adjustment means 46 is substantially similar to the device disclosed in U.S. Pat. No. 4,359,242 which has been incorporated by reference. The height adjustment means 46 differs somewhat from the unit disclosed in that patent in that handles 150 are provided for operating the height adjustment means 46 of the support member 16. In all other functional aspects, the units are identical.

Each handle 150 includes a cam surface 152 at its inner end for urging an actuator member 154 of the height adjustment means 46 in an outward direction **148*a* or 148*b*. Each actuator member 154 acts to withdraw a pin (not shown) from height adjustment means 46 when moved in direction 148*a* or 148*b*. Such withdrawal permits an operator to move the support member in a vertical direction to assume either another use position or the partially collapsed position. The novel configuration of handles 150 advantageously permits one-handed operation of the height adjustment means 46** by a user.

Figure 4:
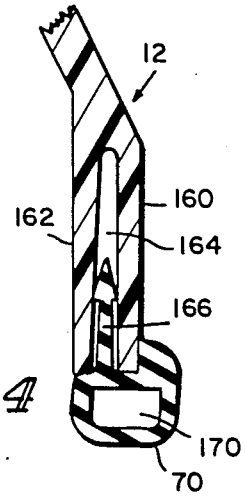
FIG. 4 is a sectional view taken along lines 4—4 of FIG. 1.

The mounting of the base grip 70 on the lower peripheral edge of the base member 12 is shown in greater detail in FIG. 4. Specifically, the base member 12 includes an outer wall 160 and an inner wall 162 which cooperate to form a channel 164. The base grip 70 is formed to include a protrusion 166 which extends into the channel 164 to secure the base grip 70 to the edge of the base member 12. The base grip 12 is formed to include an inner channel 170 which permits cushioning and flexure of the base grip 70 when it contacts a surface such as an edge of the surface 86 to provide for superior frictional contact with such a surface. This frictional contact, in combination with the functioning of the pivoting rolling units 72, 73, cooperate to provide the braking characteristics of the walker 10 as described in U.S. application Ser. No. 855,337.

Figure 5:
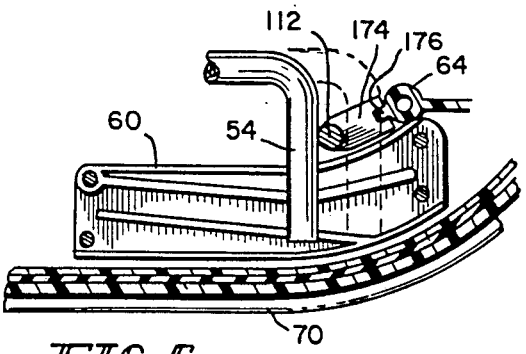
FIG. 5 is a sectional view taken along lines 5—5 of FIG. 1.

The mounting of the blocking member assembly 110 on the base member 12 is shown in greater detail in FIG. 5 Specifically, the blocking pin 112 is formed to include an outwardly extending shoe 174 which engages a rail 176 formed on the second stop member 64. The shoe 174 is configured to follow the rail 176 as the blocking member assembly 110 moves between its extended position and its retracted position. In addition, the shoe 174 acts to prevent any lateral or bending movement of the pin 112 as the pin 112 blocks movement of the rod end 54. Thus, the shoe 174 and rail 176 cooperate to both provide stability to the blocking pin 112, and act to guide the movement of the pin 112 as the blocking member assembly is moved when the extended position and the retracted position.

Although the invention has been described in detail with reference to a preferred embodiment and specific examples, variations and modifications exist within the scope and spirit of the invention as described and defined in the following claims.

What is claimed is:

1. A baby walker comprising a base, seat means for carrying a child, frame means operably connecting the base and the seat means for permitting relative movement of the seat means and the base between a fully collapsed position and at least two elevated positions, the frame means including first and second leg members extending between the base and seat means and means for pivotably connecting the first and second leg members together in criss-cross relation to permit relative movement of the first and second leg members during movement of the seat means relative to the base, and stop means coupled to the base for selectively engaging the first leg member during movement of the seat means form one of the at least two elevated positions toward the fully collapsed position to locate the seat means in the other of the at least two elevated positions to aid in preventing inadvertent movement of the seat means to its fully collapsed position.

2. The baby walker of claim 1, wherein the base is formed to include a cavity, the first leg member is slidably received in the cavity, the first leg member is movable relative to the base between a continuum of first positions corresponding to elevated positions of the seat means and a second position corresponding to the fully collapsed position of the seat means, and the stop means includes barrier means for blocking movement of the first leg member to its second position to prevent movement of the seat means to its fully collapsed position.

3. The baby walker of claim 2, wherein stop means further includes spring means acting between the barrier means and the base for yieldably biasing the barrier means to a position blocking movement of the first leg member from one of its first positions to its second positions.

4. The baby walker of claim 3, wherein the stop means further includes actuation means for retracting the barrier means against the spring means to permit movement of the first leg member from one of its first positions to its second position so that the seat means is movable to its fully collapsed position relative to the base.

5. The baby walker of claim 2, wherein the barrier means is movable relative to the base between first leg member-blocking and first leg member-releasing positions and the stop means further includes spring means for yieldably biasing the barrier means to its first leg member-blocking position.

6. The baby walker of claim 5, wherein the base is formed to include an aperture opening into the cavity, the barrier means includes a blocking member situated in the cavity and arranged to extend through the base aperture and an operating handle connected to the blocking member, and spring means is situated in the cavity to act between the blocking member and the base.

7. A baby walker comprising a base, seat means for carrying a child, frame means operably connecting the base and the seat means for permitting relative movement of the seat means and the base between a fully collapsed position and at least two elevated positions, and stop means coupled to the base for selectively engaging the frame means during movement of the seat means from one of the at least two elevated positions to position the seat means in the other of at least two elevated positions to aid in preventing inadvertent movement of the seat means to its fully collapsed position, the base being formed to include a cavity, the frame means including a leg member slidably received in the cavity, the leg member being movable relative to the base between a continuum of first positions corresponding to elevated positions of the seat means and a second position corresponding to the fully collapsed position of the seat means, the stop means including barrier means for blocking movement of the leg member to its second position to prevent movement of the seat means to its fully collapsed position, the barrier means being movable relative to the base between leg member-blocking and leg member-releasing positions and the stop means further including spring means for yieldably biasing the barrier means to its leg member-blocking position, the barrier means including means slidably engaging the base for guiding the barrier means along a vertical path during movement between its leg member-blocking and leg-member releasing positions.

8. A baby walker comprising a base, seat means for carrying a child, frame means operably connecting the base and the seat means for permitting relative movement of the seat means and the base between a fully collapsed position and at least two elevated positions, and stop means coupled to the base for selectively engaging the frame means during movement of the seat means from one of the at least two elevated positions to position the seat means in the other of the at least two elevated positions to aid in preventing inadvertent movement of the seat means to its fully collapsed position, the base being formed to include a cavity, the frame means including a leg member slidably received in the cavity, the leg member being movable relative to the base between a continuum of first positions corresponding to elevated positions of the seat means and a second position corresponding to the fully collapsed position of the seat means, the stop means including barrier means for blocking movement of the leg member to its second position to prevent movement of the seat means to its fully collapsed position, the barrier means being movable relative to the base between leg member-blocking and leg member-releasing positions and the stop means further including spring means for yieldably biasing the barrier means to its leg member-blocking position, the base being formed to include an aperture opening into the cavity, the barrier means includes a blocking member situated in the cavity and arranged to extend through the base aperture and an operating handle connected to the blocking member, the spring means being situated in the cavity to act between the blocking member and the base, the base further including a rail situated in spaced-apart parallel relation to the blocking member and the barrier means further including shoe means slidably engaging the rail for vertically guiding the operating handle during movement between its leg member-blocking and leg member-releasing positions to aid in preventing lateral and bending movement of the operating handle relative to the base.

9. A baby walker comprising a base, seat means for carrying a child, frame means operably connecting the base and the seat means for permitting relative movement of the seat means and the base between a fully collapsed position and at least two elevated positions, and stop means coupled to the base for selectively engaging the frame means during movement of the seat means from one of at least two elevated positions to position the seat means in the other of the at least two elevated positions to aid in preventing inadvertent movement of the seat means to its fully collapsed position, the base being formed to include a cavity, the frame means including a leg member slidably received in the cavity, the leg member being movable relative to the base between a continuum of first positions corresponding to elevated positions of the sat means and a second position corresponding to the fully collapsed position of the seat means, the stop means including barrier means for blocking movement of the leg member to its second position to prevent movement of the seat means to its fully collapsed position, the base including floor means within the cavity for slidably supporting the leg member during movement thereof between its first and second positions and the stop means further including support means for selectively controlling the position of the barrier means relative to the floor means to regulate passage of the leg member from its first position to its second position through a space in the cavity between the barrier means and the floor means.

10. The baby walker of claim 9, wherein the support means includes a collar attached to the barrier means, spring means acting between the base and the collar for yieldably biasing the barrier means toward the floor means, and limit means attached to the barrier means for engaging the base to limit movement of the spring-biased barrier means toward the floor means.

11. A baby walker comprising a base, seat means for supporting a baby, frame means for operably interconnecting the base and the seat means to permit guided collapsing movement of the seat means relative to the base from an elevated use position to a fully collapsed storage position, first control means for blocking relative movement of the seat means and the frame means to elevate the seat means to the elevated use position above the base, the first control means being selectively releasable to allow movement of the seat means to its fully collapsed storage position, and second control means for blocking relative movement of the frame means and the base upon release of the first control means to establish a partially collapsed position intermediate the use and storage positions to aid in preventing inadvertent movement of the seat means to its fully collapsed storage position.

12. The baby walker of claim 11, wherein the second control means is coupled to the base.

13. The baby walker of claim 11, wherein the second control means includes blocking means for intercepting a predetermined portion of the frame means during collapsing movement thereof, spring means for yieldably biasing the blocking means to a frame means-intercepting position, and actuation means for retracting the blocking means against the spring means to permit relative movement of the frame means and the base from the partially collapsed position to the fully collapsed storage position.

14. A baby walker comprising a base, seat means for carrying a child, at least one frame assembly including a pair of leg members pivotably coupled at their centers, a first of the leg members having one end pivotally connected to the seat means and another end slidably connected to the base, and a second of the leg members having one end pivotally connected to the base and another end slidably connected to the seat means to permit movement of the seat means and the base between a fully collapsed position and at least two elevated positions, and stop means coupled to the base for selectively engaging the another end of the first leg member to position the seat means in one of the at least two elevated positions to aid in preventing inadvertent movement of the seat means to its fully collapsed position.

* * * * *

UNITED STATES PATENT AND TRADEMARK OFFICE

CERTIFICATE OF CORRECTION

PATENT NO. : 4,799,700

DATED : January 24, 1989

INVENTOR(S) : Roy E. Knoedler, Kenneth P. Morton and Charles E. Schroer

It is certified that error appears in the above-identified patent and that said Letters Patent is hereby corrected as shown below:

At column 3, line 12, please delete "Permit" and insert therefor --permit--;

At column 4, line 2, please delete "Pliable" and insert therefor --pliable--;

At column 4, line 43, please delete "Substantially" and insert therefor --substantially--;

At column 6, line 16, please delete "extend" and insert therefor --extends--;

At column 7, line 47, please delete "form" and insert therefor --from--; and

At column 9, line 51, please delete "sat" and insert therefor --seat--.

Signed and Sealed this

Thirteenth Day of June, 1989

*Attest:*

DONALD J. QUIGG

*Attesting Officer*

*Commissioner of Patents and Trademarks*